US005868090A

United States Patent [19]

Hartsell, Jr.

[11] Patent Number: 5,868,090

[45] Date of Patent: Feb. 9, 1999

[54] PLACKET SEWING MACHINE

[75] Inventor: Billie W. Hartsell, Jr., Mt. Pleasant, N.C.

[73] Assignee: John E. Fox, Inc., Charlotte, N.C.

[21] Appl. No.: 63,573

[22] Filed: Apr. 21, 1998

Related U.S. Application Data

[63] Continuation of Ser. No. 580,580, Dec. 29, 1995.

[51] Int. Cl.[6] ..... D05B 19/00; D05B 69/18

[52] U.S. Cl. ..... 112/272; 112/260

[58] Field of Search ..... 112/272, 275, 112/277, 470.01, 470.03, 475.02, 475.03, 475.09

[56] References Cited

U.S. PATENT DOCUMENTS

| | | | |
|---|---|---|---|
| 4,227,470 | 10/1980 | Mitchell | 112/130 X |
| 4,343,255 | 8/1982 | Kelly et al. . | |
| 4,471,706 | 9/1984 | Hubele et al. . | |
| 4,495,877 | 1/1985 | Willenbacher . | |
| 4,574,719 | 3/1986 | Balke . | |
| 4,696,246 | 9/1987 | Rohr | 112/272 |
| 4,967,676 | 11/1990 | Hagino et al. . | |
| 5,215,020 | 6/1993 | Pordzik | 112/272 X |

OTHER PUBLICATIONS

Hartsell, Jr. Prior Embodiment Photograph and Written Description, prior to Dec. 29, 1994.

*Primary Examiner*—Peter Nerbun

*Attorney, Agent, or Firm*—Adams Law Firm, P.A.

[57] ABSTRACT

A placket sewing machine is provided for attaching a placket patch to a fabric part of a garment. The placket patch and fabric part are positioned in overlying relation to form a multiple layer placket assembly. The placket patch has a leading end for being fed together with the fabric part through the sewing machine, and a trailing end. A sewing head is mounted above the base of the machine, and includes at least one reciprocating sewing needle. The sewing head is operatively connected to a motor for actuating the sewing needle. A controller controls operation of the sewing motor. A throat plate supports the overlaid placket patch and fabric part on the working surface of the machine base in an area of the sewing needle. The throat plate includes a side extension located outside of the area of the sewing needle. A ply-sensing assembly including a transmitter and receiver is operatively connected to the controller for automatically stopping operation of the sewing motor and needle upon sensing the trailing end of the placket patch. The extension of the throat plate defines a port therein for holding the receiver in signal passage alignment with the transmitter during placket sewing operations.

6 Claims, 7 Drawing Sheets

Fig. 5
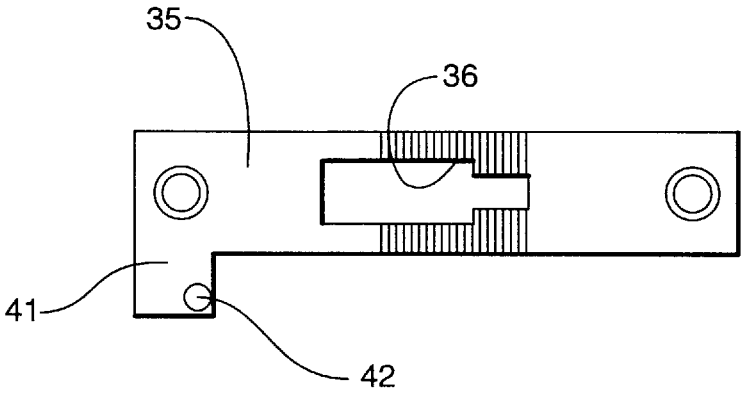
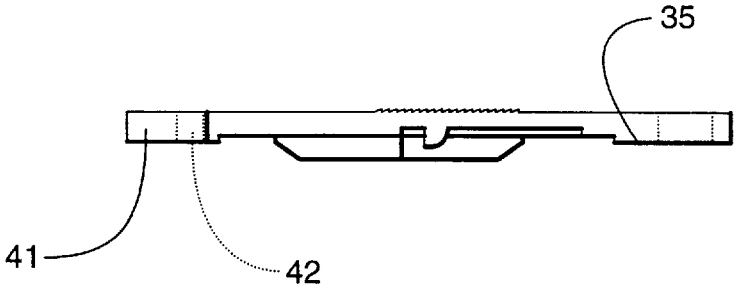
Fig. 6

PLACKET SEWING MACHINE

This application is a continuation of U.S. patent application Ser. No. 08/580,580 file Dec. 29, 1995.

TECHNICAL FIELD AND BACKGROUND OF THE INVENTION

This invention relates to a placket sewing machine, and method of forming a placket assembly. The invention has particular application in the assembly of Alley Solley shirt plackets, such as that common in golf and other casual knit shirts. The invention utilizes automatic ply-sensing with a light transmitter mounted adjacent to the sewing head, and a fiber optic cable housed within the base of the machine in alignment with the transmitter. The transmitter and fiber optic cable cooperate to determine the trailing end of the placket, and to automatically stop sewing and cutting of the placket patch and shirt front at an exact location.

The process of forming a shirt placket requires relatively precise sewing and cutting of the overlaid placket patch and shirt front. The placket patch is typically sewn to the shirt front using a conventional double needle sewing machine with a center cutter located between or slightly to the rear of the needles. The double needles sew parallel lines of stitch in the placket patch and shirt front while the cutter cuts the fabric parts at a center point between the stitch lines. Ideally, the stitch lines terminate at the trailing edge of the placket patch such that the entire length of patch is sewn to the shirt front, and is properly cut.

Prior to the invention, the machine operator would manually feed and guide the overlaid placket patch and shirt front through the sewing machine, and attempt to stop the sewing motor at the exact moment the trailing edge of the placket patch was reached. This manual technique was generally slow, and often produced rejects due primarily to human error.

In an effort to overcome this problem, some prior art machines employed an electronic motor with stitch counting capability. The machine automatically stopped sewing after a predetermined stitch count at a point intended to correspond to the trailing edge of the placket patch. Although this machine was far more effective than the manual technique, it nevertheless suffered from many drawbacks and limitations. For example, stitch counting was unable to compensate for different size patches, placement variations, different stitch lengths, cloth puckering, and poor handling of the cloth by the machine operator.

The present invention overcomes these and other problems of the prior art by utilizing a light transmitter and fiber optic cable for sensing the end of the placket patch, and automatically stopping operation of the sewing motor to produce a consistently accurate stitch and cut. The signal receiving end of the fiber optic cable is secured in an opening formed in the throat plate of the sewing machine in an area outside of the sewing and cutting elements of the machine. The fiber optic cable will not interfere with or be damaged by the sewing needles or cutter, yet is positioned sufficiently close to these elements to accurately determine the trailing edge of the placket patch and relay this information to a programmable motor controller to stop the machine at the desired point. Moreover, by modifying the throat plate to hold the fiber optic cable, the cable is easily routed from the relatively open area beneath the throat plate to the motor controller. Alternative positioning of the cable would likely require expensive and difficult modifications to generally solid areas of the machine base.

SUMMARY OF THE INVENTION

Therefore, it is an object of the invention to provide a placket sewing machine which utilizes ply-sensing for automatically determining the trailing end of the placket patch.

It is another object of the invention to provide a placket sewing machine which includes a novel throat plate with an opening for housing a signal-receiving end of fiber optic cable in an area outside of the sewing and cutting elements of the machine.

It is another object of the invention to provide a placket sewing machine which is specifically adapted for use in forming Allen Solley shirt plackets.

These and other objects of the present invention are achieved in the preferred embodiments disclosed below by providing a placket sewing machine for attaching a placket patch to a fabric part of a garment. The placket patch and fabric part are positioned in overlying relation to form a multiple layer placket assembly. The placket patch has a leading end for being fed together with the fabric part through the sewing machine, and a trailing end.

The placket sewing machine includes a base defining a working surface of the sewing machine. The base includes a fabric moving feed dog for moving the overlaid placket patch and fabric part downstream through the sewing machine. A sewing head is mounted above the base, and includes at least one reciprocating sewing needle. The sewing head is operatively connected to a motor for actuating the sewing needle. Controller means controls operation of the sewing motor.

A throat plate supports the overlaid placket patch and fabric part on the working surface of the machine base in an area of the sewing needle. The throat plate defines an opening therein for accommodating passage of the reciprocating needle and upward movement of the feed dog. The throat plate further includes a side extension located outside of the area of the sewing needle.

Ply-sensing means are operatively connected to the controller means for automatically stopping operation of the sewing motor and needle upon sensing the trailing end of the placket patch. The ply-sensing means includes a transmitter mounted adjacent to the sewing head. The transmitter transmits a ply-sensing signal of an intensity sufficient for penetrating the thickness of the fabric part, while being interrupted by a multi-layer thickness of the overlaid placket patch and fabric part.

A receiver is located in the base of the machine in signal-passage alignment with the transmitter for receiving the signal of the transmitter through the fabric part. The transmitter and receiver are located respectively on opposite sides of the overlaid placket patch and fabric part. Upon interruption of the ply-sensing signal indicating a presence of both the placket patch and fabric part, the controller means maintains operation of the sewing motor and needle, and upon receiving the ply sensing signal of the transmitter indicating an absence of the placket patch, the controller means stops operation of the sewing motor and needle. The extension of the throat plate defines a port therein for holding the receiver in signal passage alignment with the transmitter during placket sewing operations.

According to one preferred embodiment of the invention, the at least one sewing needle includes first and second spaced apart sewing needles for sewing parallel lines of stitch.

According to another preferred embodiment of the invention, a fabric cutter is located downstream of and centrally disposed between the first and second sewing needles for cutting the placket patch and fabric part after sewing.

According to yet another preferred embodiment of the invention, the transmitter includes a variable intensity light beam.

According to yet another preferred embodiment of the invention, the receiver is a fiber optic cable operatively connected to the controller.

According to yet another preferred embodiment of the invention, the port formed in the extension of the throat plate includes an internal screw thread. A free end of the fiber optic cable includes a complementary external screw thread for being securely received into the port.

According to yet another preferred embodiment of the invention, removable attachment means are provided for removably attaching the throat plate to the base of the sewing machine.

According to yet another preferred embodiment of the invention, the removable attachment means are externally threaded screws.

According to one preferred embodiment of the invention, a throat plate is adapted for use in combination with a placket sewing machine for supporting an overlaid placket patch and fabric part on a working surface of the placket sewing machine. The throat plate defines an opening therein for accommodating passage of a reciprocating sewing needle, and a fabric moving feed dog for moving the overlaid placket patch and fabric part downstream of the sewing needle. The throat plate includes a side extension located outside of the area of the sewing needle. The side extension defines a port therein for holding a receiver in signal passage alignment with a ply-sensing transmitter during placket sewing operations.

An embodiment of the method according to the invention comprises the steps of positioning the placket patch and fabric part in overlying relation on a working surface of a placket sewing machine. The sewing machine includes a fabric moving feed dog extending upwardly from the working surface, at least one reciprocating sewing needle, and a sewing head operatively connected to a motor for actuating the sewing needle. Controller means is provided for controlling operation of the sewing motor.

A throat plate supports the overlaid placket patch and fabric part on the working surface of the sewing machine in an area of the sewing needle. The throat plate defines an opening therein for accommodating passage of the reciprocating needle and feed dog. The throat plate includes a side extension located outside of the area of the sewing needle.

Ply-sensing means are operatively connected to the controller means for automatically stopping operation of the sewing motor and needle upon sensing the trailing end of the placket patch. The ply-sensing means includes a transmitter mounted adjacent to the sewing head for transmitting a ply-sensing signal of an intensity sufficient for penetrating the thickness of the fabric part, and for being interrupted by the multi-layer thickness of the overlaid placket patch and fabric part.

A receiver is located in the base of the machine in signal-passage alignment with the transmitter for receiving the signal of the transmitter through the fabric part. The transmitter and receiver are located respectively on opposite sides of the overlaid placket patch and fabric part. Upon interruption of the ply-sensing signal indicating a presence of the placket patch and fabric part, the controller means maintains operation of the sewing motor and needle, and upon receiving the ply sensing signal from the transmitter indicating an absence of the placket patch, the controller means stops operation of the sewing motor and needle. A port is formed in the extension of the throat plate for holding the receiver in signal passage alignment with the transmitter during placket sewing operations.

BRIEF DESCRIPTION OF THE DRAWINGS

Some of the objects of the invention have been set forth above. Other objects and advantages of the invention will appear as the invention proceeds when taken in conjunction with the following drawings, in which:

FIG. 5 is a top plan view of a throat plate according to one preferred embodiment of the invention for use in a placket sewing machine;

FIG. 6 is a side elevational view of the throat plate;

DESCRIPTION OF THE PREFERRED EMBODIMENT AND BEST MODE

Figure 1:
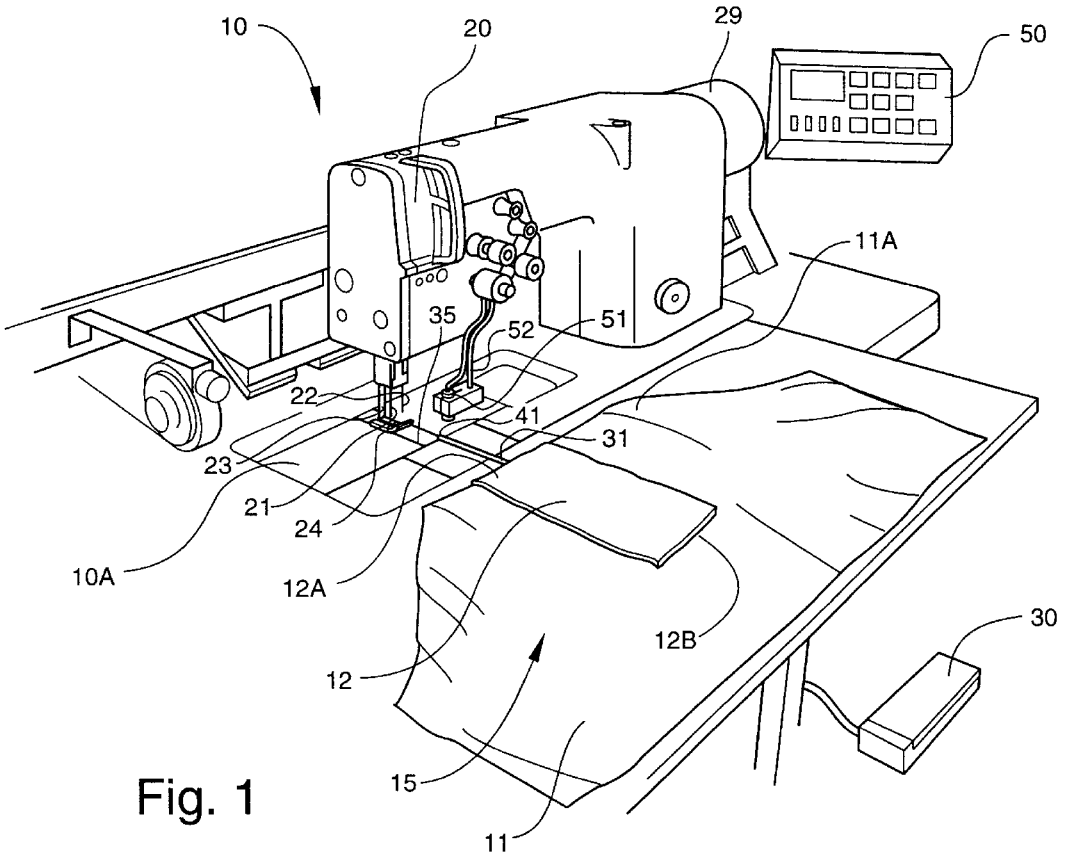
FIG. 1 is a perspective view of the placket sewing machine according to one preferred embodiment of the invention, and showing a shirt front and overlaid placket patch just prior to being fed through the sewing and cutting elements of the machine.
Figure 2:
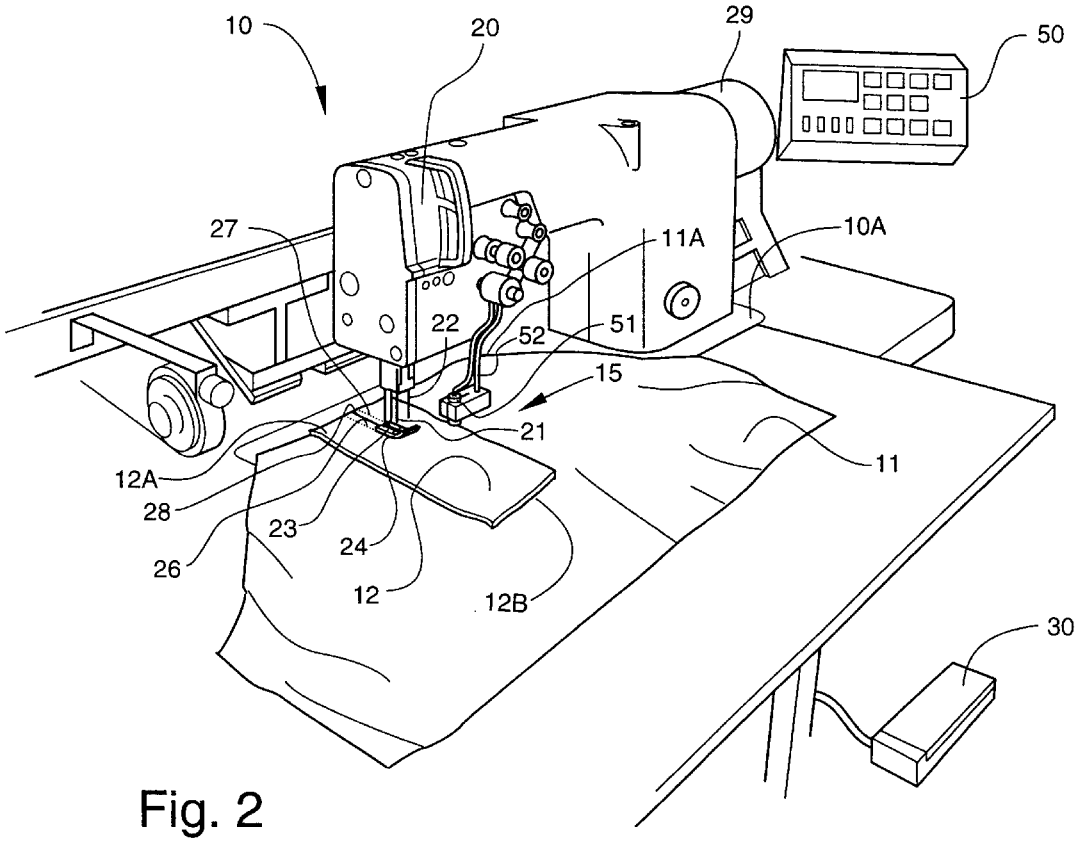
FIG. 2 is a perspective view of the placket sewing machine, and showing the shirt front and overlaid placket patch moving downstream through the sewing and cutting elements of the machine.

Referring now specifically to the drawings, a placket sewing machine according to the present invention is illustrated in FIGS. 1 and 2, and shown generally at reference numeral 10. The sewing machine is particularly adapted to form an Alley Solley shirt placket "P", such as that illustrated generally in FIG. 3.

Referring to FIGS. 1 and 2, a shirt front 11 and overlaid placket patch 12 are positioned on a working surface of the sewing machine 10 with respective front edges 11A and 12A aligned in registration to define a leading end of a shirt placket assembly 15. An opposite rear edge 12B of the placket patch 12 defines a trailing end of the placket assembly 15.

Figure 3:
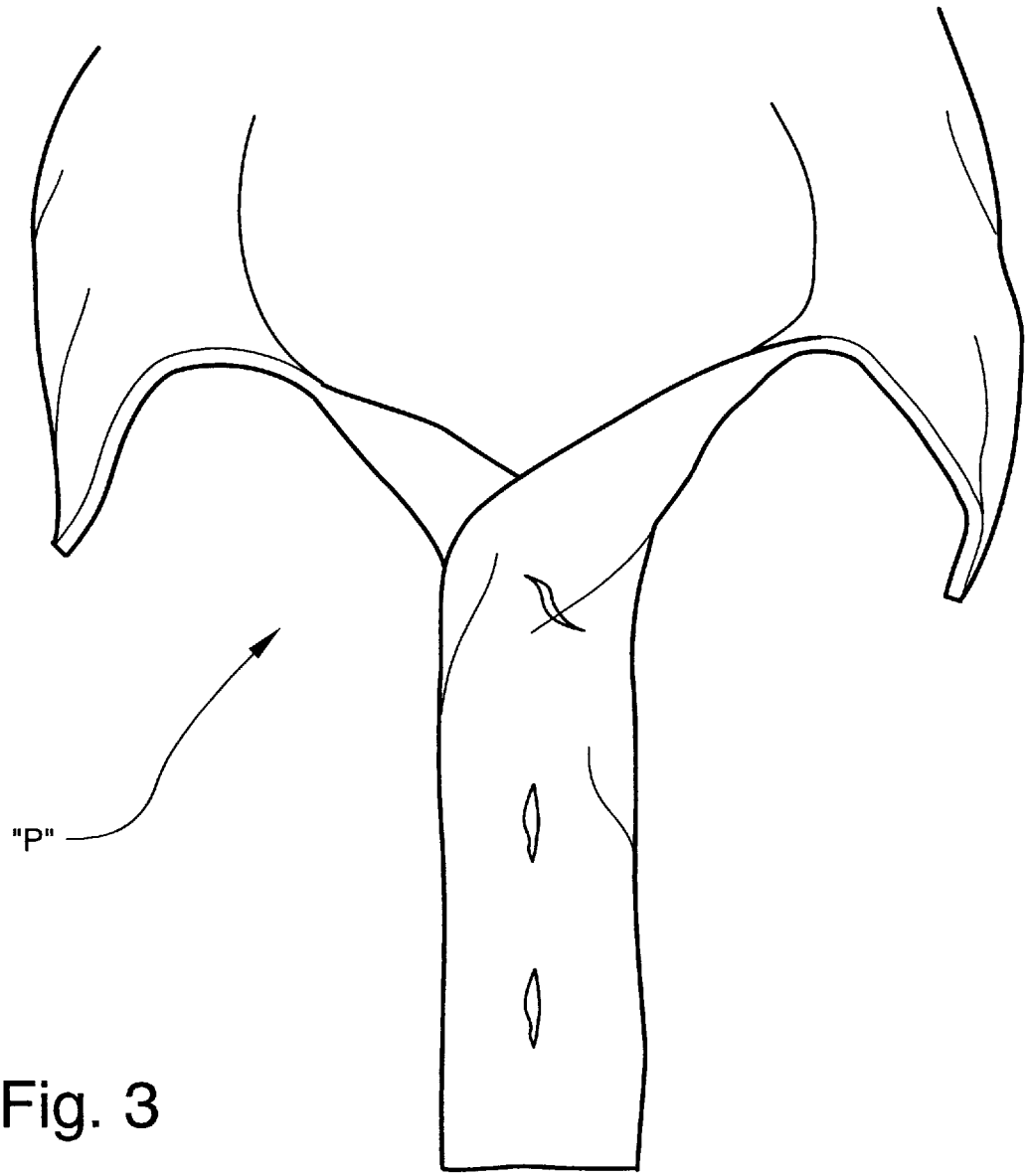
FIG. 3 is a fragmentary view of an Allen Solley shirt placket.

As described further below, the placket assembly 15 is fed into the sewing machine 10 and moved downstream for sewing and cutting. After reaching the trailing end of the placket patch 12, the machine 10 automatically stops operation, thus forming a precise cut and stitch in the placket assembly 15. The placket assembly 15 is subsequently formed into a shirt placket "P" as shown in FIG. 3.

Figure 4:
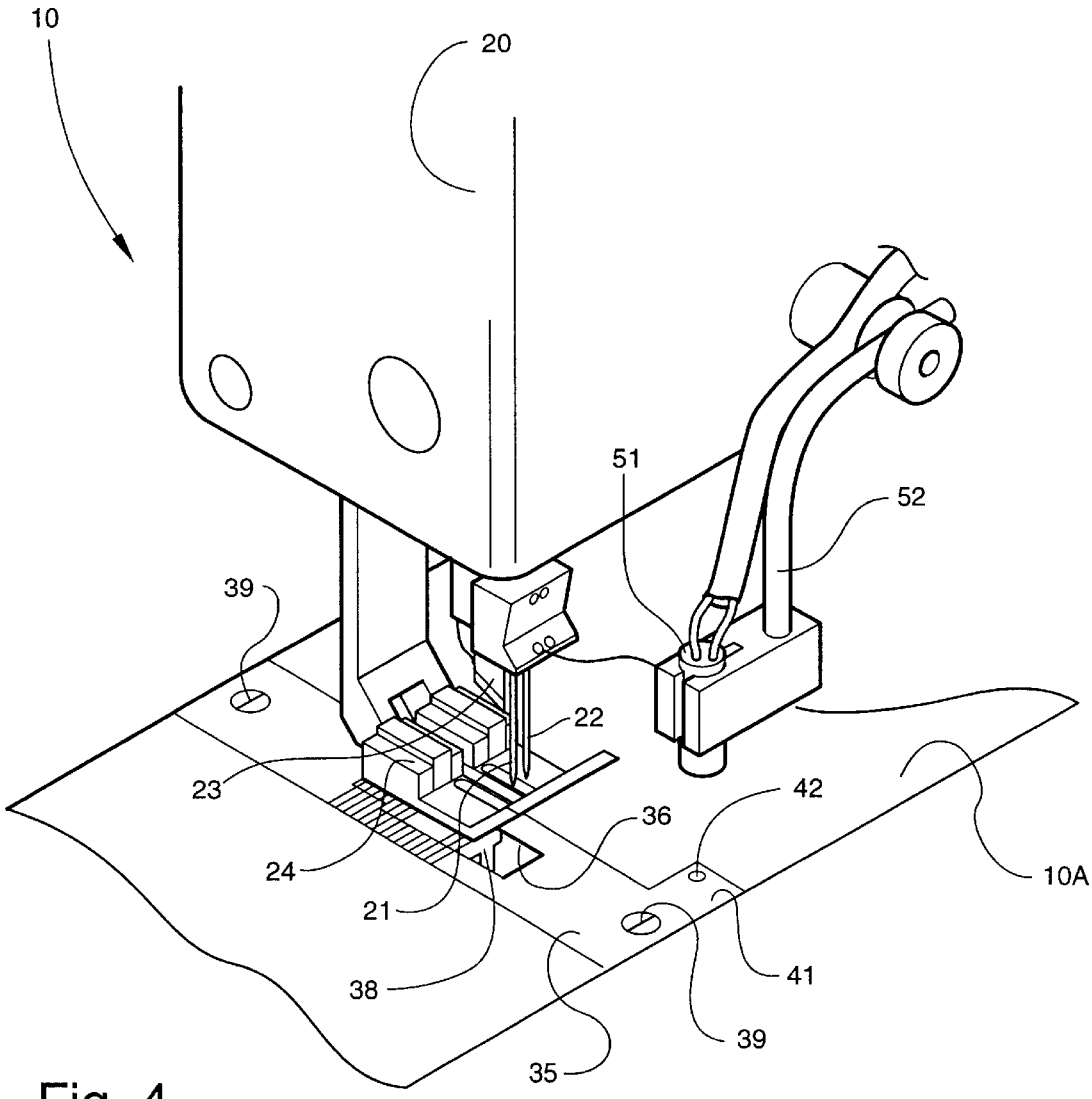
FIG. 4 is an enlarged, fragmentary perspective view of the cutting and sewing elements of the placket sewing machine.

The sewing and cutting elements of the machine 10 are best illustrated in FIG. 4. A conventional sewing head 20 carries a pair of reciprocating needles 21 and 22, a cutter 23, and a presser foot 24. These elements operate in conjunction to simultaneously form two spaced apart parallel lines of stitching 26 and 27 in the placket assembly 15. The cutter 23 cuts the placket assembly 15 at a center point 28 between the two stitch lines 26 and 27, as indicated in FIG. 2. A standard electronic sewing motor (not shown) operates a drive shaft assembly 29 to actuate the needles 21 and 22 and cutter 23. The motor is connected to a footpad control 30 for being depressed by a machine operator. Preferably, a guide bar 31 is provided on the working surface of the sewing machine 10 to maintain a straight sew and cut as the placket assembly 15 is moved by the operator downstream through the sewing machine 10.

Referring to FIG. 5 and 6, a throat plate 35 is located immediately below the sewing head 20 on a base 10A of the sewing machine 10, and includes a center opening 36 vertically aligned with the presser foot 24 for accommodating passage of the reciprocating needles 21 and 22 and cutter 23 downwardly into the base 10A. A feed dog 38 is periodically exposed upwardly through the center opening 36 for engaging and urging the placket assembly 15 downstream through the sewing machine 10. Preferably, the throat plate 35 is removably secured to the base 10A of the machine 10 by threaded screws 39.

An extension 41 is integrally formed with one side of the throat plate 35, and includes an internally threaded port 42 for receiving and holding a complementary threaded end of fiber optic cable 44 in an area of the base 10A outside of the sewing and cutting elements of the machine 10. The fiber optic cable 44 extends from the throat plate 35 through the base 10A, and communicates with a programmable motor controller 50. The motor controller 50 includes an override command for automatically stopping operation of the sewing motor.

Figure 7:
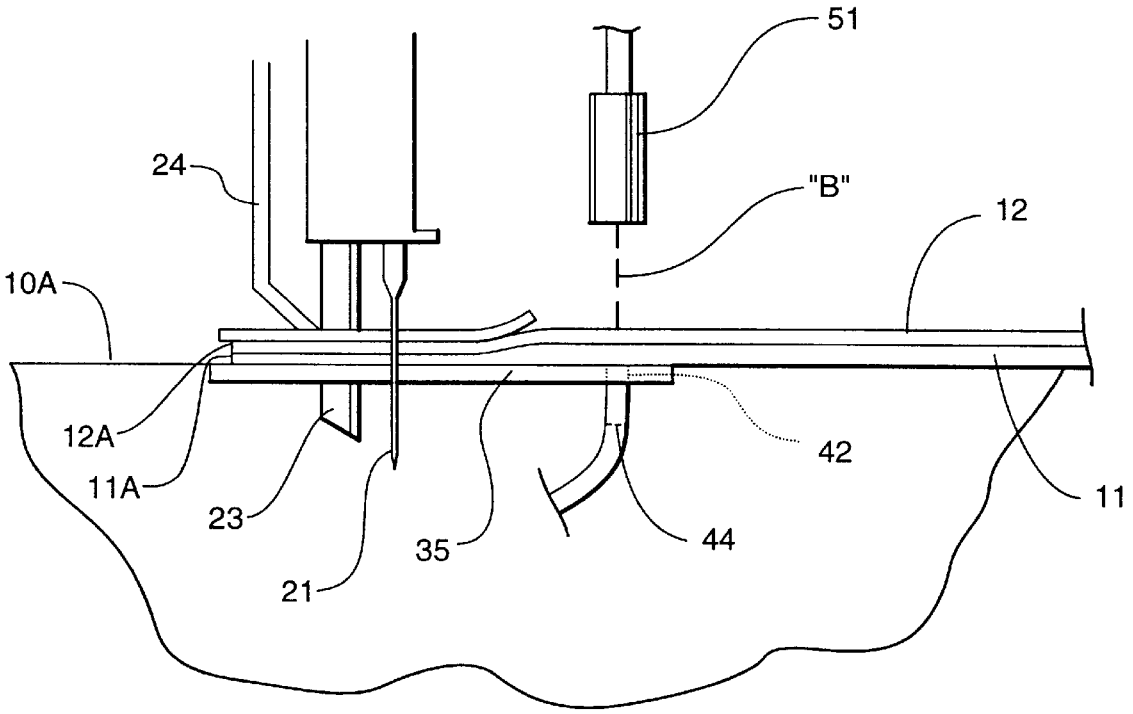
FIG. 7 is a fragmentary, side elevational view of the placket sewing machine with a leading end of the placket patch and shirt front fed into the sewing and cutting elements of the machine, thereby blocking transmission of the light beam from the transmitter to the receiver.
Figure 8:
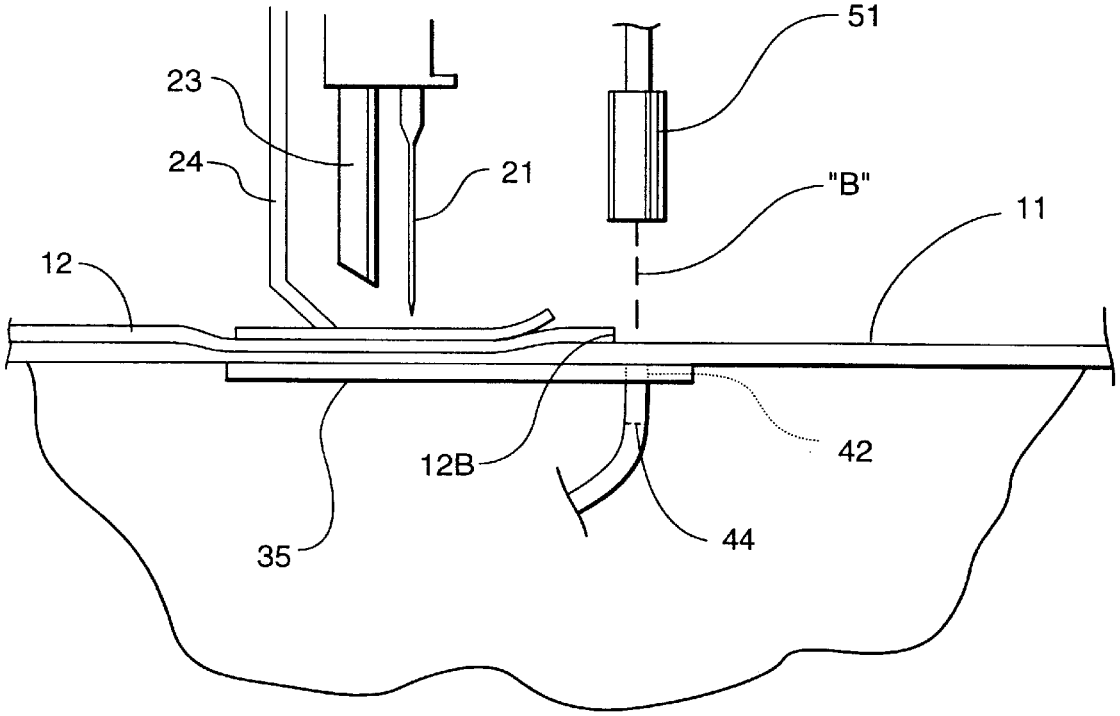
FIG. 8 is a fragmentary, side elevational view of the placket sewing machine with a trailing end of the placket patch located downstream of the transmitter and receiver, and showing transmission of the light beam from the transmitter through the shirt front and into the receiver.

As shown in FIGS. 4, 7, and 8, a transmitter 51 is secured to a support arm 52 in precise signal-passage alignment with the fiber optic cable 44 for transmitting a high intensity light beam "B" in a direction of the fiber optic cable 44. Passage of the light beam "B" into the cable 44 triggers the override command of the motor controller 50, and automatically stops operation of the sewing motor. The sewing motor will not operate in this condition regardless of pressure applied by the operator to the footpad 30. To operate the sewing motor, transmission of the light beam "B" into the fiber optic cable 44 must be blocked, and the footpad 30 simultaneously depressed by the operator.

Referring to FIGS. 7 and 8, the light transmitter 51 and fiber optic cable 44 cooperate to sense the trailing end of the placket assembly 15, and thereby direct the motor controller 50 to automatically stop sewing and cutting operations of the sewing motor. As shown in FIG. 7, the double thickness of the shirt front 11 and overlaid placket patch 12 is sufficient to interrupt passage of the light beam "B" into the fiber optic cable 44.

Thus, with the footpad 30 depressed, the machine operator manually feeds the leading end of the placket assembly 15 into the sewing machine 10 covering the port 42 of the throat plate 35. The relative thickness of the fabric parts 11 and 12 blocks transmission of the light beam "B" into the receiving end of the fiber optic cable 44 to permit operation of the sewing motor. The reciprocating needles 21 and 22 and cutter 23 of the sewing head 20 stitch and cut the packet assembly 15 as described above, while the feed dog 38 moves the placket assembly 15 downstream through the machine 10.

Upon reaching the trailing end of the placket assembly 15, as shown in FIG. 8, the light beam "B" of the transmitter 51 penetrates the fabric of the shirt front 11, and passes into the receiving end of fiber optic cable 44 located in the port 52 of the throat plate 35. Operation of the sewing motor stops, and the placket assembly 15 is subsequently moved downstream for further processing.

Preferably, the intensity of the light beam "B" is adjustable to accommodate the particular fabric of the shirt front 11. For example, a heavier cloth may require increased beam intensity. In addition, the motor controller 50 may be programmed to account for tight knit or loose knit fabrics, and to automatically stop the sewing motor after a predetermined stitch count, thus accounting for the distance between the transmitter 51 and sewing needles 21 and 22. An example of a suitable motor controller is that manufactured by EFKA of Germany, and sold as part number DC 1600 JU82 V740.

After sewing and cutting as described above, the placket assembly 15 preferably enters an automatic positioning apparatus to complete formation of the placket assembly. One suitable positioning machine is that described in U.S. Pat. No. 4,227,470. The complete disclosure of this patent is expressly incorporated herein by reference.

A placket sewing machine is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A placket sewing machine for attaching a placket patch to a fabric part of a garment in overlying relation to form a multiple layer placket assembly, said placket patch having a leading end thereof for being fed together with the fabric part through the sewing machine and a trailing end thereof, the placket sewing machine comprising:

(a) a base defining a working surface of the sewing machine, and including a fabric moving feed dog for moving the overlaid placket patch and fabric part downstream through the sewing machine;

(b) a sewing head mounted above the base, and comprising a reciprocating sewing needle, tie sewing head being operatively connected to a motor for actuating the sewing needle to create a line of sewing stitches in the placket assembly thereby attaching the placket patch and fabric part together;

(c) controller means for controlling operation of the sewing motor;

(d) a fabric cutter located downstream of said sewing needle for cutting the placket patch and fabric part after sewing;

(e) a throat plate for supporting the overlaid placket patch and fabric part on the working surface of the machine base in an area of the sewing needle and cutter, said throat plate defining an opening therein for accommodating passage of the reciprocating needle and cutter and movement of the feed dog;

said throat plate further comprising a side extension plate formed perpendicular to an edge of said throat plate and extending coplanar to said throat plate away from the area of the sewing needle, and said side extension plate including a receiver port therein laterally spaced-apart from the opening in said throat plate to reside outside the line of sewing stitches formed in the placket assembly;

(f) ply-sensing means operatively connected to the controller means for automatically stopping operation of the sewing motor and needle upon sensing the trailing end of the placket patch, said ply-sensing means comprising:

i. a transmitter mounted adjacent to the sewing head for transmitting a ply-sensing signal of a sufficient intensity such that the signal is capable of penetrating the single layer thickness of the fabric part, and is interrupted by the multi-layer thickness of the overlaid placket patch and fabric part; and ii. a receiver located in the base of said machine and held in the receiver port of said side extension plate in signal-passage alignment with the transmitter for receiving the signal of the transmitter through the fabric part, said transmitter and receiver being located respectively on opposite sides of the overlaid placket patch and fabric part, whereby upon interruption of the ply-sensing signal indicating a presence of both the placket patch and fabric part, the controller means maintains operation of the sewing motor and needle, and upon receiving the ply sensing signal of the transmitter indicating an absence of the placket patch, the controller means stops operation of the sewing motor and needle.

2. A placket sewing machine according to claim 1, wherein said transmitter comprises a light beam.

3. A placket sewing machine according to claim 1, wherein said receiver comprises a fiber optic cable operatively connected to said controller.

4. A placket sewing machine according to claim 3, wherein said port formed in the extension plate of said throat plate includes an internal screw thread, and wherein a free end of said fiber optic cable includes a complementary external screw thread for being securely received into said port.

5. A placket sewing machine according to claim 1, and including removable attachment means for removably attaching the throat plate to the base of the sewing machine.

6. A placket sewing machine according to claim 5, wherein said removable attachment means comprises externally threaded screws.

* * * * *